US005819457A

United States Patent [19]

Parker

[11] Patent Number: 5,819,457

[45] Date of Patent: Oct. 13, 1998

[54] SPORTS TEAMS STANDING APPARATUS

[76] Inventor: Raymond J. Parker, 50 Maynard St., Apt. 114, Attleboro, Mass. 02703

[21] Appl. No.: 675,920

[22] Filed: Jul. 5, 1996

[51] Int. Cl.[6] ..... A47G 7/00

[52] U.S. Cl. ..... 40/657; 40/620

[58] Field of Search ..... 40/657, 617, 618, 40/584, 124.1, 124; D6/300–310; D20/10, 40, 42; D11/132, 133

[56] References Cited

U.S. PATENT DOCUMENTS

| | | | |
|---|---|---|---|
| D. 240,365 | 6/1976 | Bennett | D11/133 X |
| D. 291,850 | 9/1987 | Perkins et al. . | |
| D. 324,793 | 3/1992 | Johnson | D6/303 X |
| D. 366,798 | 2/1996 | Messersmith | D6/303 X |
| D. 369,625 | 5/1996 | Nevels | D20/42 |
| 2,965,978 | 12/1960 | Olson | 40/657 X |
| 3,458,946 | 8/1969 | Lassewell | 40/657 |
| 3,822,494 | 7/1974 | Zivica . | |
| 3,949,506 | 4/1976 | Benkowski . | |
| 4,878,585 | 11/1989 | Orestano . | |

*Primary Examiner*—Cassandra H. Davis
*Attorney, Agent, or Firm*—John A. Haug

[57] ABSTRACT

A support (12) has a playing field (14) demarked thereon with a plurality of sets (16, 18, 20, 26, 28, 30) of attachment devices. Each set has an attachment devices in the form of a hook member (24) for each team of a league for removable attachment of a team designator (40) unique to the respective team of the league. Separate attachment devices (34, 36) are provided for the winner of each league and the ultimate winner of the World Series (38).

1 Claim, 2 Drawing Sheets

SPORTS TEAMS STANDING APPARATUS

This invention relates generally to sports activities and more particularly to apparatus for tracking and displaying the relative standings of teams of an organized league or leagues.

BACKGROUND OF THE INVENTION

U.S. Pat. No. 3,949,506 discloses an ornamental plaque having a plurality of discs having the name of different teams and a decorative feature such as a boss in the form of a football helmet on respective discs and adapted to be removably mounted on the plaque. The discs can be positioned in a numerical sequence to designate team standings.

SUMMARY OF THE INVENTION

It is an object of the invention to provide an improved sport teams standing apparatus which can be used to track standings of teams of related leagues as well as reflect inter-league championships. Another object is the provision of teams standings apparatus which can be made of inexpensive materials so that it can be readily affordable for children as well as adults. Yet another object is the provision of apparatus for displaying the relative standings of teams of one or more leagues which use novel team designators.

These and other objects, features and advantages of the present invention will become apparent from the following detailed description of the invention.

Briefly, in accordance with the invention, a support is provided having a generally planar face surface on which a playing field for a selected sport is demarked. Respective sets of attachment means, such as hook members, are placed on loci spaced from one another on the face surface. Each set includes a sequence of the attachment means, one for each team of a league, denoting relative standings of the teams. For each attachment means a team designator is provided for removably mounting on respective attachment means. Additional attachment means are disposed at a separate location to recieve intra and inter-league champions.

According to a feature of the invention the team designators preferably are configured as miniature sporting implements in the selected sport which also serve as collectibles. In the described specific embodiment in which baseball is the selected sport a baseball field is demarked with sets of attachment means in the form of hook members disposed at loci spaced at upper and lower ends of a support with respective hook members of each set representing standings in a league, from first to last place in the respective league. The upper sets are dedicated to the American League, East, Central and West respectively and the lower sets are dedicated to the National League, East, Central and West respectively. An individual hook member is disposed on each of the left and right sides of the diamond for reception of the American League champion and the National League champion respectively while a single hook member is disposed in the center of the diamond for the World Series champion. The team designators are shown to be miniature bats, each having a team's indentifying indicia on a respective bat, e.g., the logo of the team. An eye member is attached to the end of each bat for removable reception on any of the hook member.

Various team designators can be used for a given sport. For example, in baseball, baseball caps could also be used. For football, football helmets or jerseys can be used. Hockey sticks of jerseys can be used for hockey, crosses for la-crosse, soccer balls for soccer. Typically, the designator chosen is representantive and commonly identified with the particular sport and the playing field representative of the actual playing field for that sport.

Additional objects and advantages of the invention will be set forth in part in the description which follows and in part will be obvious from the description. The objects and advantages of the invention may be realized and attained by means of the instrumentalities and combinations particularly pointed out and in the appended claims.

BRIEF DESCRIPTION OF THE DRAWINGS

The accompanying drawings, which are incorporated in and constitute a part of the specification, illustrates a preferred embodiment of the invention and together with the description serve to explain the objects, advantages and the principles of the invention. In the drawings.

DETAILED DESCRIPTION OF PREFERRED EMBODIMENTS

Figure 1:
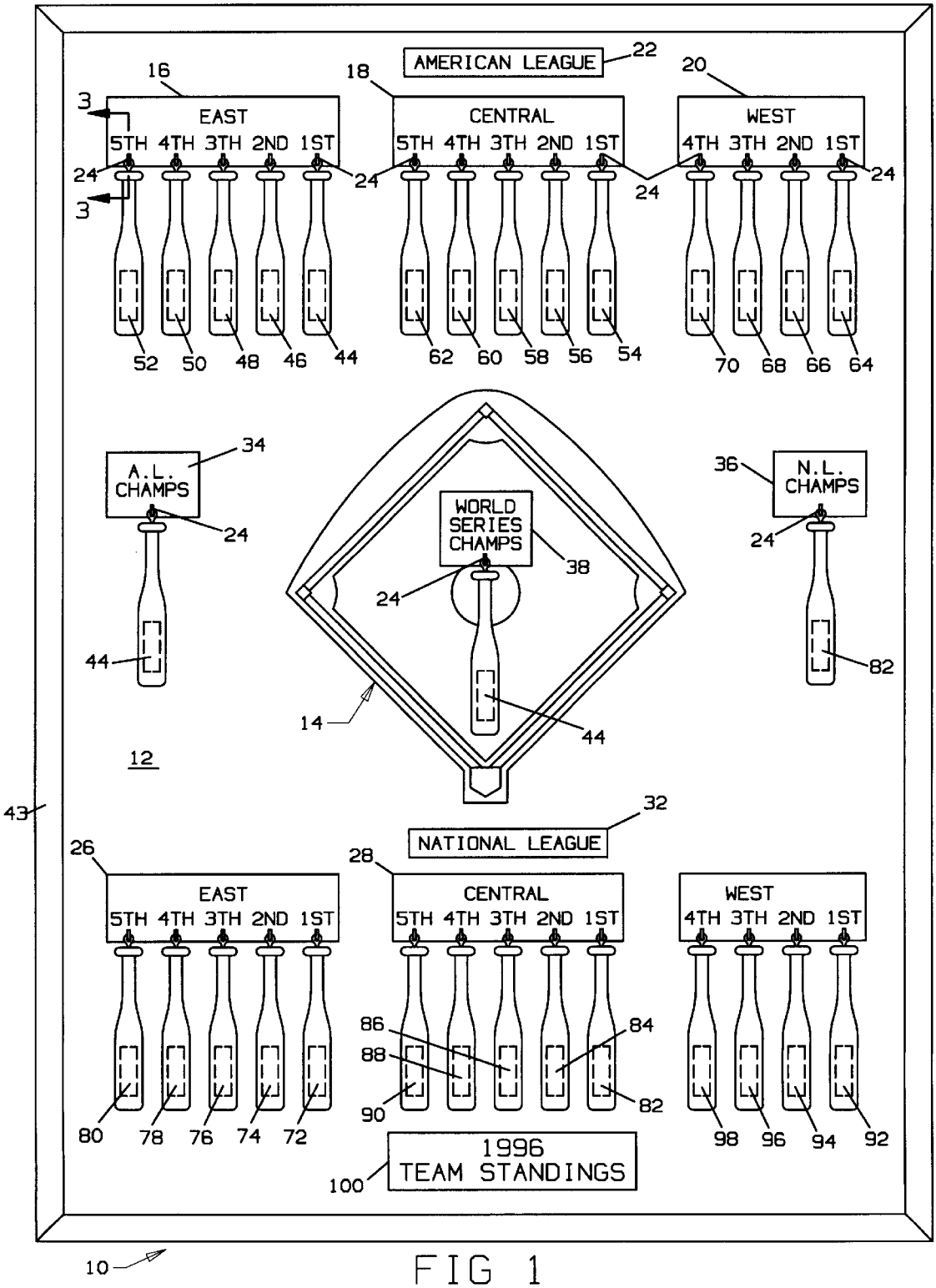
FIG. 1 is a front elevational view of a support apparatus adapted for mounting on a wall made in accordance with the invention.

Turning now to FIG. 1 a sports teams standing apparatus 10 is shown comprising a support 12 in the form of a board having a generally planar surface on which a playing field related to a selected sport is demarked. Although support 12 is shown generally rectangular in configuration, it will be understood that the particular shape of the support is a matter of choice. In the specific embodiment being described, a baseball diamond 14 is generally centrally located on support 12. Above diamond 14, first, second and third sets 16, 18, 20 respectively of attachment means are disposed on loci spaced from one another and identified as East, Central and West respectively. The sets are in turn identified as units of the American League by name plate 22. Each set of attachment means comprises a plurality of hook members 24 arranged in a series or sequence and identified respectively as first through fifth in the East and Central and first through fourth in the West.

Below diamond 14, corresponding first, second and third sets 26, 28 and 30 repectively of attachment means are disposed on loci spaced from one another and identified as East, Central and West respectively. These sets are in turn identified as units of the National League by name plate 32. Each set of attachment means comprise a plurality of hook members 24 arranged in a series and identified respectively as first through fifth for the East and Central and first through fourth for the West. It will be understood that as teams are added to or subtracted from a league the sets can be changed accordingly.

On one side, the left side as shown in the drawing, a single attachment means in the form of a hook member 24 is located and identified by a name plate 34 as American League champions. On the opposite, right side of the diamond, another single attachment means in the form of a hook member 24 is located and identified by a name plate 36 as National League champions. In the center of the diamond yet another single attachment means in the form of a hook member 24 is located and identified by name plate 38 as World Series champions.

Figure 2:
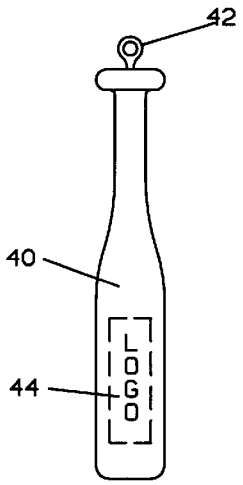
FIG. 2 is a front elevational view of a team designator used in the FIG. 1 apparatus.

With particular reference to FIG. 2, a designator 40 in the form of a miniature bat is provided for each of the attachment means of sets 16, 18, 20, 26, 28 and 30. Designator 40 is provided with a suitable eye 42 which can be formed integrally with the designator of separately and screwed into an end of the bat, e.g., the handle end as shown in the figure. Each designator 40 is unique to a team bearing indicia such as a logo 44–48 respectively. The indicia may be engraved, embossed or otherwise attached to the designator to identify each respective team in the unit, or in the described embodiment, the team of the league.

Support 12 can be provided with a frame 43 and can be adapted to be mounted on a suitable stand or it can be wall mounted as a conventional picture or plaque. As the playing season progresses the team designators can be moved from one attachment means to another within each respective set to reflect the team's current actual standing within the league. This tends to develop general interest in current events of the sports activity and among children helps to develop reading skills and even basic mathematical skills in keeping track of games won and lost and related statistics.

Once the regular season has concluded and the American and National League champions are determined then either the same designator as that used in the league sets, or preferably a duplicate of the team designator winning the respective league championship can be placed on the attachment means provided at name plates 34 and 36. Finally, after the World Series has been decided the ultimate winner can be placed on the attachment means at name plate 38.

Each year a new name plate 100 can be placed on support 12 for the respective year.

Figure 3:
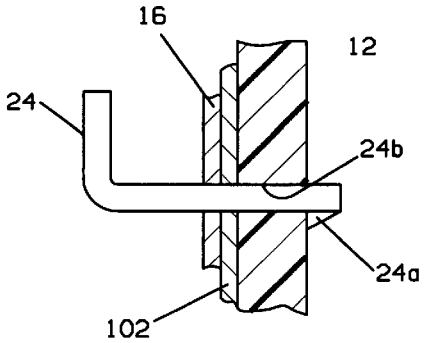
FIG. 3 is a cross sectional view taken on line 3—3 of FIG. 1 showing a hook member used as an attachment means shown with the team designator removed from purposes of illustration and shown with an additional outer layer 102.
Figure 6:
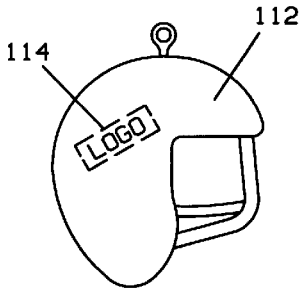
FIGS. 4–7 are front elevational views of team designators used for various other sports.
Figure 4:
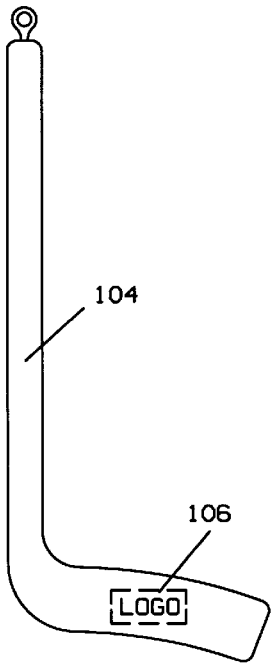
Figure 5:
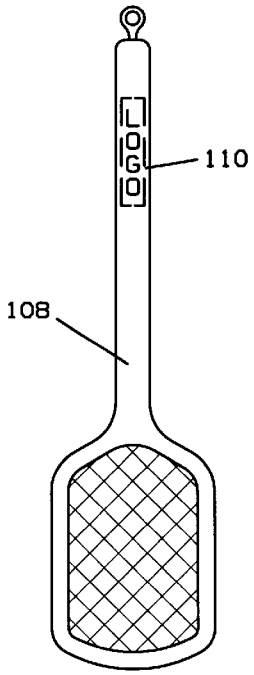
Figure 7:
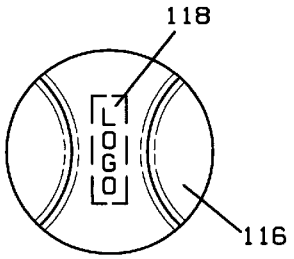

It will be realized that support 12 and the attachment means can be fabricated from any suitable material. With reference to FIG. 3 hook member 24 can be a generally L-shaped member having a suitable retaining portion 24*a* which can be inserted in aperture 24*b* of support 12. Aperture 24*b* can be aligned with name plate 16 and similar apertures can be aligned with the other name plates shown in FIG. 1 or the apertures could be spaced therefrom, as desired. The particular playing field could be formed directly on the support face or on an outer layer 102 placed over a peg board so that changes could easily be accommodated, e.g., the addition or subtraction of teams merely by using a different layer 102 and placing hook members 24 as called for. Further, a support of this type could accommodate various different sports activities merely by placing the appropriate outer layer having the selected sports field thereon, such as a basketball court, hockey rink, etc. As noted in FIGS. 4–7 several examples are shown of designators for such other sports, viz., hockey stick 104 of FIG. 4 with its logo 106, the crosse 108 of FIG. 5 with its logo 110, football helmet 112 of FIG. 6 with its logo 114 and soccer or basketball 116 with its logo 118.

The designators not only serve as component parts of the sport teams standing apparatus but also can serve as collectibles for fans of the sporting activities.

It will be seen that the invention provides a sports teams standing apparatus which fullfills the objects of the invention. Although a hook member is disclosed as the attachment means it is within the purview of the invention to employ other suitable attachment members, for example apertures in the support which receive pins attached to the designators.

It should be understood that though preferred embodiments of the invention have been described by way of illustrating the invention, this invention includes all modifications and equivalents of the disclosed embodiments falling within the scope of the appended claims.

It is claimed:

1. Sport teams standing apparatus for reflecting the performance of baseball teams and for updating such reflections comprising:

a support having a generally planar face, an outline of a baseball diamond demarked on a central portion of the generally planar face, a plurality of planar spaced first indication means positioned at longitudinal spaced locations from the baseball diamond demarked on the face, a first plurality of attachment device on the first indication means positioned spaced from one another serially from first place to last place for the teams of a first league, a plurality of planar spaced second indication means positioned at longitudinal spaced locations from the baseball diamond demarked on the face opposite the first indication means, a second plurality of attachment devices on the second indication means positioned spaced from one another serially from first place to last place on for the teams of a second league, a third and fourth indication means positioned at lateral spaced locations on opposite sides of the baseball diamond demarked on the face, a fifth single attachment device positioned on each of the third and fourth indication means respectively, the third and fourth indication means for respective intra-league champion, and a sixth single attachment device positioned on a fifth indication means within the perimeter of the baseball diamond for inter-league champion, and a miniature teams designator in the form of a baseball bat for each team and having a respective identifying indicia of a respective team thereon, the designator removably receivable on each attachment device.

* * * * *